US005462464A

United States Patent [19]

Ming

[11] Patent Number: 5,462,464

[45] Date of Patent: Oct. 31, 1995

[54] OUTBOARD MOTOR WITH OIL SUMP COOLING ARRANGEMENT

[75] Inventor: Lam H. Ming, Tsing Yi Island, Hong Kong

[73] Assignee: Outboard Marine Corporation, Waukegan, Ill.

[21] Appl. No.: 253,862

[22] Filed: Jun. 3, 1994

[51] Int. Cl.[6] ..... B63H 21/38

[52] U.S. Cl. ..... 440/88; 123/196 AB; 184/104.3

[58] Field of Search ..... 123/196 AB; 184/104.3; 440/88, 89, 76

[56] References Cited

U.S. PATENT DOCUMENTS

| | | | |
|---|---|---|---|
| 3,301,230 | 1/1967 | Ryusuke Ito | 123/196 AB |
| 3,493,081 | 2/1970 | Tado | 123/196 AB |
| 4,150,655 | 2/1979 | Gaggiano | 184/104.3 X |
| 4,611,559 | 9/1986 | Sumigawa | 123/196 A |
| 4,709,671 | 12/1987 | Sumigawa | 123/196 S |
| 4,828,519 | 5/1989 | Watanabe | 440/88 |
| 4,950,191 | 8/1990 | Wenstadt | 440/89 |
| 5,232,387 | 8/1993 | Sumigawa | 440/88 |

FOREIGN PATENT DOCUMENTS 61-229915 10/1986 Japan .

*Primary Examiner*—Sherman Basinger

*Attorney, Agent, or Firm*—Michael, Best & Friedrich

[57] ABSTRACT

Disclosed herein is a drive shaft housing including outer side walls extending in spaced relation to each other, a forwardly located wall extending between the outer side walls, a rearwardly located wall spaced rearwardly from the forwardly located wall and extending between the outer side walls, a bottom wall extending between the outer side walls and between the forwardly and rearwardly located walls, which outer side walls, which forwardly and rearwardly located walls, and which bottom wall define an oil sump, a coolant passage extending vertically in one of the outer side walls, the forwardly located wall, and the rearwardly located wall, being adapted, adjacent the upper end thereof, for connection to a source of coolant, and terminating, at the lower end thereof, in a port located in the bottom wall, and a deflector fixed to the bottom wall and defining with the bottom wall a conduit extending along the bottom wall and having one end communicating with the coolant passage and a second end having an elongated discharge area, whereby to provide coolant flow along a substantial portion of the bottom surface of the bottom wall.

23 Claims, 3 Drawing Sheets

OUTBOARD MOTOR WITH OIL SUMP COOLING ARRANGEMENT

BACKGROUND OF THE INVENTION

The invention relates generally to four stroke outboard motors including sumps or reservoirs for lubricating oil. More particularly, the invention relates to arrangements for extracting heat from the oil in such sumps.

Attention is directed to the following U.S. Pat. Nos.:

4,611,559 Sumigawa Sep. 16, 1986

4,709,671 Sumigawa Dec. 1, 1987

4,828,519 Watanabe May 9, 1989

Attention is also directed to Japanese patent application No. 61-229915

SUMMARY OF THE INVENTION

The invention provides a drive shaft housing including outer side walls extending in spaced relation to each other, a forwardly located wall extending between the outer side walls, a rearwardly located wall spaced rearwardly from the forwardly located wall and extending between the outer side walls, a bottom wall extending between the outer side walls and between the forwardly and rearwardly located walls, which outer side walls, which forwardly and rearwardly located walls, and which bottom wall define an oil sump, and a deflector fixed to the bottom wall and defining with the bottom wall a conduit extending along the bottom wall and having a first end adapted to communicate with a source of coolant, and a second end having an elongated discharge area, whereby to provide coolant flow along a substantial portion of the bottom surface of the bottom wall.

The invention also provides an oil sump including outer side walls extending in spaced relation to each other, a forwardly located wall extending between the outer side walls, a rearwardly located wall spaced rearwardly from the forwardly located wall and extending between the outer side walls, a bottom wall extending between the outer side walls and between the forwardly and rearwardly located walls, and a deflector fixed to the bottom wall and defining with the bottom wall a conduit extending along the bottom wall and having a first end adapted to communicate with a source of coolant, and a second end having an elongated discharge area, whereby to provide coolant flow along a substantial portion of the bottom surface of the bottom wall.

In one embodiment, the drive shaft housing and the oil sump further include a coolant passage extending vertically in one of the outer side walls, the forwardly located wall, and the rearwardly located wall, being adapted, adjacent the upper end thereof, for connection to a source of coolant, and terminating, at the lower end thereof, in a port located in the bottom wall, and communicating with the first end of the conduit extending along the bottom wall.

The invention also provides an outboard motor comprising a power head including a cooling jacket, a lower unit including a gear case, an intermediate drive shaft housing portion having a lower end fixed to the gear case and having an upper end, and an upper drive shaft housing portion including a lower end fixed to the upper end of the intermediate drive shaft housing portion, an upper end fixed to the power head, outer side walls extending in laterally spaced relation to each other between the upper and lower ends of the upper housing portion, a forwardly located wall extending between the outer side walls, a rearwardly located wall spaced rearwardly from the forwardly located wall and extending between the outer side walls, a bottom wall extending between the outer side walls and between the forwardly and rearwardly located walls, which outer side walls, which forwardly and rearwardly located walls, and which bottom wall define an oil sump, a coolant passage extending vertically in the rearwardly located wall, being adapted, adjacent the upper end thereof, for connection to the power head coolant jacket for receipt therefrom of coolant discharged from the power head cooling jacket, and terminating, at the lower end thereof, in a port in the bottom wall, and a deflector fixed to the bottom wall and defining with the bottom wall a forwardly extending fan shaped conduit communicating with, and extending forwardly from, the port to a discharge area so as to enable coolant flow from the coolant passage conduit and along a substantial portion of the bottom surface of the bottom wall.

The invention also provides an outboard motor comprising a power head including a cooling jacket, and a lower unit including a gear case rotatably supporting a propeller, an intermediate drive shaft housing portion having a lower end connected to the gear case, and an upper end, an upper drive shaft housing portion including an upper end fixed to the power head, a lower end fixed to the upper end of the intermediate drive shaft housing portion, a transverse wall located adjacent the lower end of the upper drive shaft housing portion, defining, in part, an oil sump, and including therein an opening located rearwardly of the oil sump and adapted to receive an exhaust gas pipe having, at the lower end thereof, a discharge opening delivering exhaust gas into the interior space in the lower unit below the transverse wall, and a coolant discharge passage adapted, adjacent the upper end thereof, for connection to the power head coolant jacket for receipt therefrom of coolant discharge, and including, at the lower end thereof, a forwardly directed coolant discharge area located below the transverse wall, forwardly of the exhaust pipe, and adapted to forwardly discharge coolant into the interior space in the lower unit below the transverse wall, an idle exhaust gas relief char formed in the lower unit below the transverse wall, first port means communicating between the idle exhaust gas relief chamber and the atmosphere, and second port means communicating between the idle exhaust gas relief chamber and the interior space in the lower unit below the transverse wall and at a location rearwardly of the forwardly directed coolant discharge area.

The invention also provides an outboard motor comprising a power head including a cooling jacket, and a lower unit including a gear case rotatably supporting a propeller, an intermediate drive shaft housing portion having an upper end defining an interior space, and a lower end connected to the gear case, an upper drive shaft housing portion including an upper end fixed to the power head, a lower end fixed to the upper end of the intermediate drive shaft housing portion, outer side walls extending in laterally spaced relation to each other between the upper and lower ends of the upper drive shaft housing portion, a forwardly located wall extending between the outer side walls, a rearwardly located wall spaced rearwardly from the forwardly located wall and extending between the outer walls, a bottom wall located at the lower end of the upper drive shaft housing portion and extending between the outer side walls and between the forwardly and rearwardly located walls, defining, with the outer side walls and the forwardly and rearwardly located walls, an sump, and including therein an opening located rearwardly of the rearward wall and adapted to receive an exhaust gas pipe having, at the lower end thereof, a discharge opening delivering exhaust gas into the interior space at the upper end of the intermediate drive shaft housing portion, and a coolant passage extending vertically in the rearwardly located wall and being adapted, adjacent the upper end thereof, for connection to the power head coolant jacket for receipt therefrom of coolant discharge, and terminating, at the lower end thereof in a forwardly directed discharge area located below the bottom wall and forwardly of the exhaust pipe, an idle exhaust gas relief chamber forward in the lower unit below the bottom wall, first port means communicating between the idle exhaust gas relief chamber and the atmosphere, and second port means communicating between the idle exhaust gas relief chamber and the interior space below the bottom wall and at a location rearwardly of the forwardly open coolant discharge area.

Other features and advantages of the invention will become apparent to those skilled in the art upon review of the following detailed description, claims, and drawings.

THE DRAWINGS

Figure 4:
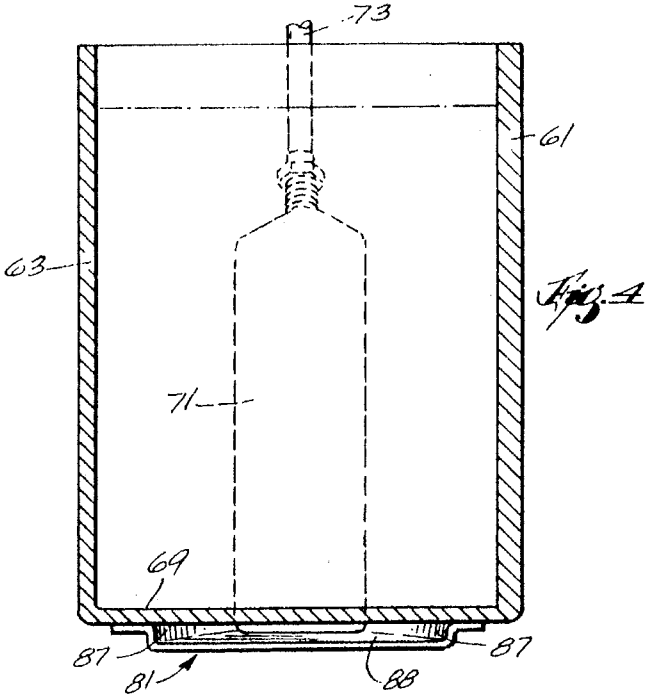
FIG. 4 is a fragmentary sectional view taken along line 4—4 of FIG. 3.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Illustrated in the drawings is a four stroke outboard motor 11 including an oil sump 13 located in a lower unit or drive shaft housing assembly 15 and provided with means for cooling a substantial portion of the bottom wall thereof. More particularly, the outboard motor 11 includes a power head 17 which can be of any suitable construction and which includes a cooling jacket 19 which is shown schematically and which has a discharge port 21 provided with a thermostatically operated valve 23 which permits coolant discharge when either the engine block or the coolant is at a temperature above a predetermined level. The power head 17 also includes a vertically oriented output shaft 25.

While other constructions could be employed, in the disclosed construction the drive shaft housing assembly 15 is of three piece construction. Specifically, the drive shaft housing assembly 25 includes a gear case portion 31 including a rotatably mounted propeller shaft 33 supporting a propeller 35. In addition, the drive shaft housing assembly 15 includes an intermediate section or portion 41 which includes a lower end suitably fixed to the gear case portion 31 and an upper end.

Still further in addition, the drive shaft housing assembly 15 includes an upper section or portion 51 having a lower end suitably fixed to the upper end of the intermediate section or portion 41 and which includes an upper end suitably fixed to the power head 17.

One alternative construction comprehends the casting of the upper portion 51 and the intermediate portion 41 as a single piece.

Located in the upper housing portion 51 is the sump 13 which can take other forms, as for instance, which can depend from and be supported by the power head 17 independently of the drive shaft housing assembly 15, and which, in disclosed construction, is integrally formed in the upper housing portion 51 which preferably is a one-piece aluminum casting.

More specifically, in the disclosed construction, the sump 13 is defined by (see FIG. 4) the outer port and starboard side walls 61 and 63, respectively, of the upper housing portion 51, by ( see FIG. 3 ) a front side wall 65 which extends laterally between the outer side walls 61 and 63 rearwardly of drive shaft 55 which extends from the output shaft 25, by a rear side wall 67 which extends laterally between the outer side walls 61 and 63, and by a bottom or transverse wall 69 extending, at least in part, between the outer side walls 61 and 63, and between the front and rear side walls 65 and 67. In the specifically disclosed construction, the bottom wall 69 also extends rearwardly of the rear side well 67.

Means are provided for cooling a substantial part of the bottom wall 69 and at least one of the outer side walls 61 and 63, the front side wall 65, and the rear side wall 67.

While other constructions can be employed, in the disclosed construction, one of the sump side walls 61, 63, 65, and 67 includes a side wall conduit or coolant passage 71 which affords coolant flow therein, which, at its upper end, is adapted to communicate with a suitable source of coolant, as for instance, a flexible conduit 73 connected either to the thermostatic valve 23 or to another suitable coolant source, such as a water pump (not shown), or a line (not shown) branching from the supply line to the power head cooling jacket 19. In the disclosed construction, the side wall conduit or coolant passage 71 is formed in the rear wall 67.

Figure 1:
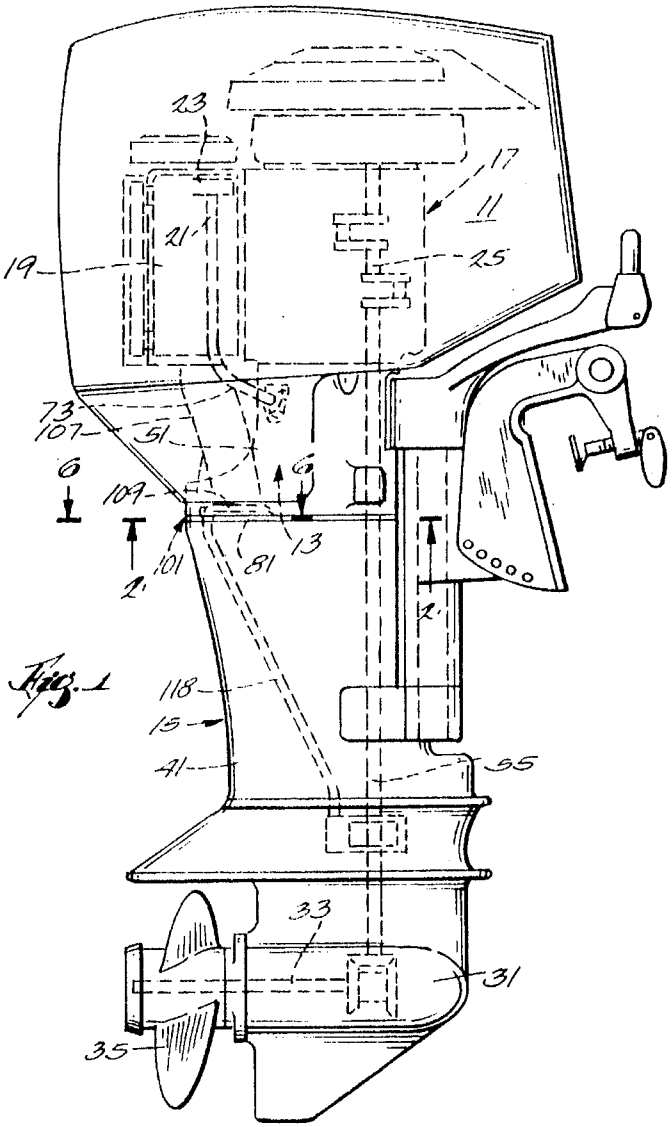
FIG. 1 is a side elevational view of an outboard motor incorporating various of the features of the invention.
Figure 2:
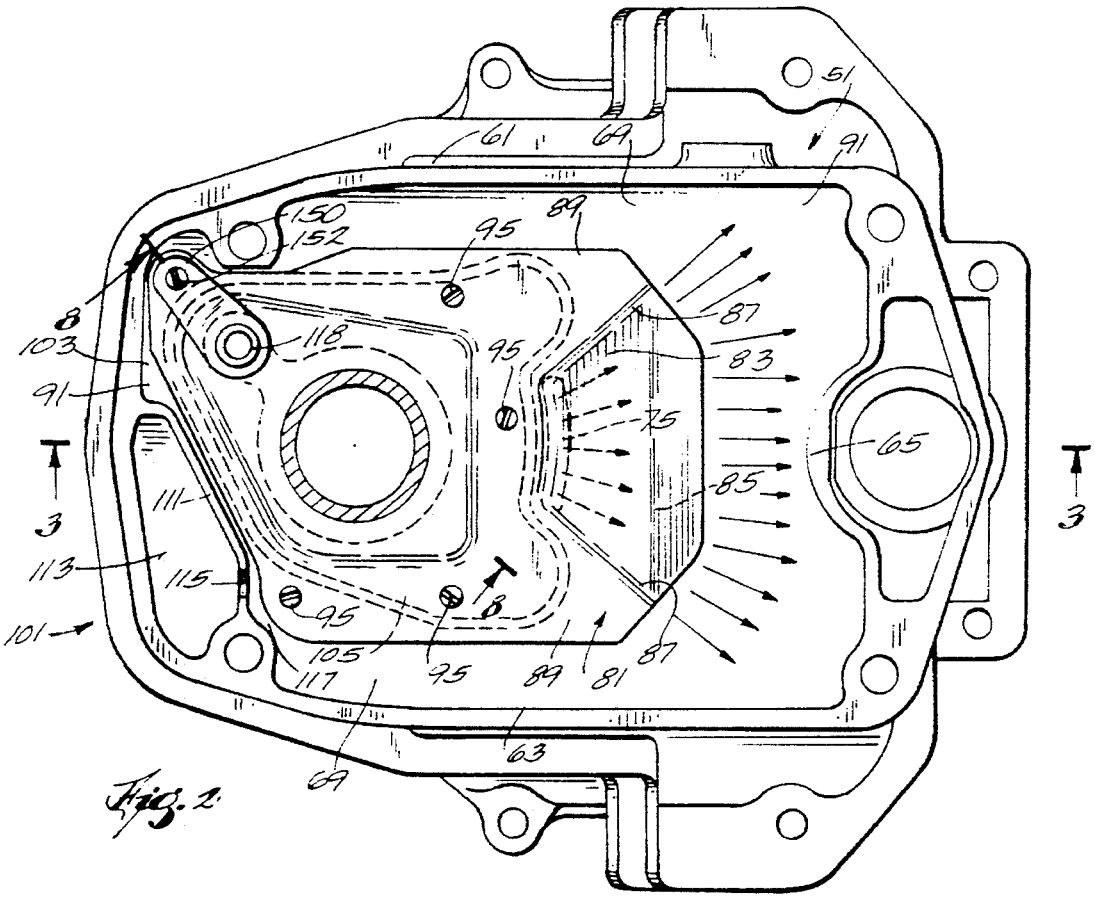
FIG. 2 is an enlarged view taken along line 2—2 of FIG. 1.
Figure 6:
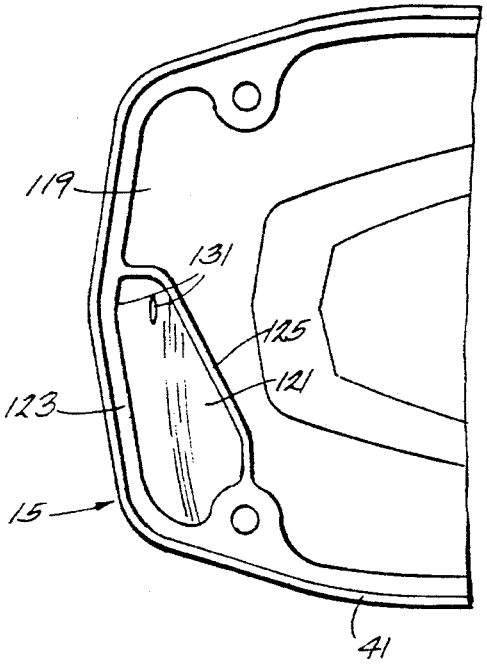
FIG. 6 is a fragmentary view taken along line 6—6 of FIG. 1.

At its lower end, the side wall conduit or coolant passage 71 terminates in a port 75 formed in the bottom wall 69. Thus coolant flows vertically through the side wall conduit or coolant passage 71, and serves to cool the rear side wall 67 of the sump 13. It is particularly noted, as shown in FIG. 1, 2, and 4, that the side wall conduit 71 has substantial lateral length in the rear side wall 67.

Various arrangements can be employed for cooling a substantive portion of the sump bottom wall 69, such as conduit formed interiorly in the sump bottom wall 69. In the disclosed construction, there is provided a fan shaped bottom wall conduit 77 which extends along the bottom surface of the bottom wall 69, which communicates, at one end, with the port 75 at the lower end of the side wall conduit 71, and which, at its other or forward end, is laterally elongated and open for discharge of the coolant into the intermediate section or portion 41 of the drive shaft housing assembly 15.

While other constructions can be employed, in the disclosed construction, the bottom wall conduit 77 is defined by the bottom surface of the bottom wall 69 of the sump 13 and by a deflector or deflector plate 81 which is suitably fixed to the bottom wall 69 in tight engagement therewith and which includes a dished or recessed portion 83 extending in spaced relation to the bottom wall 69 and communicating, at its rearward, end with the port 75 and being open at its forward end 88, for coolant discharge as just described. More particularly, the bottom wall conduit 77 Is defined by outer sides 87 which diverge from the port 75 toward the discharge area 88, and a marginal portion 89 extending along and from the side and rear peripheries and in engagement with the bottom wall 69. At its rearward end adjacent the port 75, the bottom wall conduit 77 has a lateral extent approximating the lateral extent of the coolant passage 71. Because of the diverging sides 87 and the consequent fan shape of the bottom wall conduit 77, the lateral extent of the discharge end 88 of the bottom wall conduit 77 is substantially greater than the lateral extent adjacent the port 75.

Figure 5:
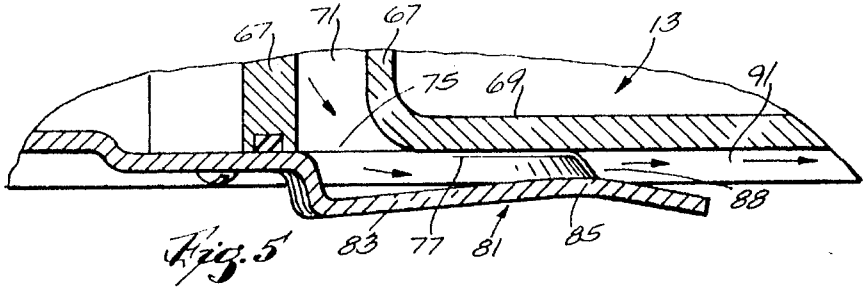
FIG. 5 is an enlarged fragmentary view, partially in section, of a portion of the outboard motor shown in FIGS. 1 through 4.
Figure 3:
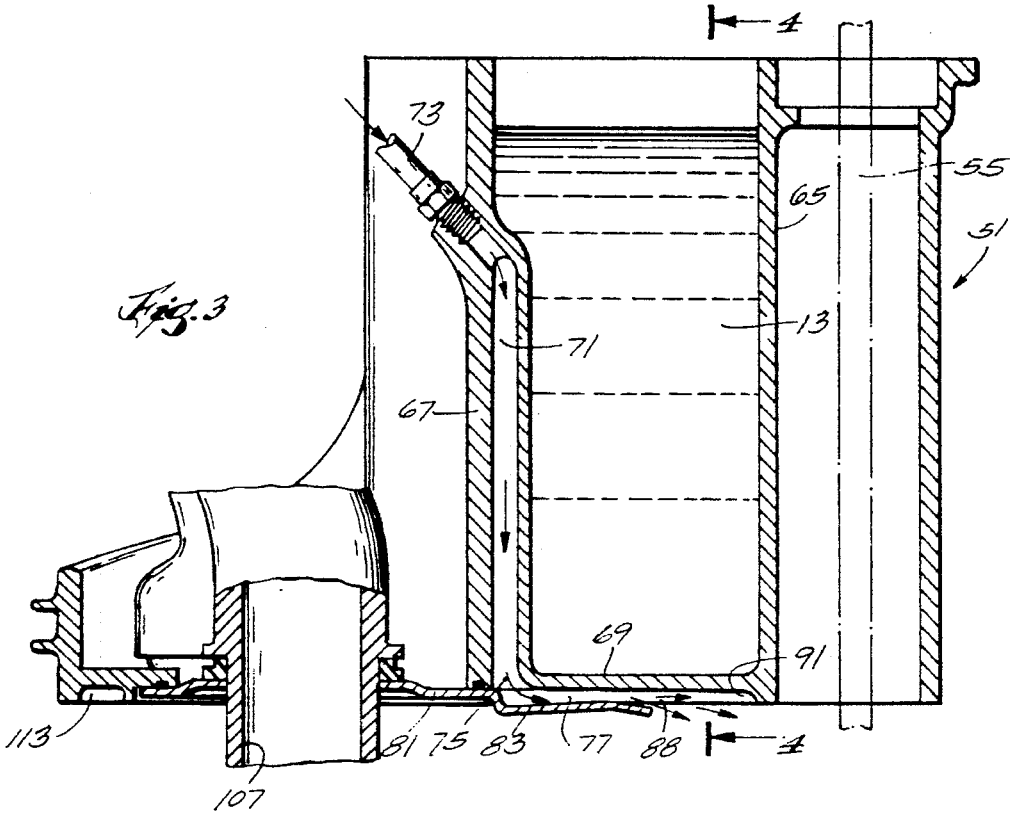
FIG. 3 is a sectional view taken along line 3—3 of FIG. 2.

As can be seen in FIGS. 3 and 5, the deflector 81 has a free edge at the coolant discharge area 88.

While, in the disclosed construction, the bottom wall conduit 71 is fan shaped, other shapes and sizes can be employed.

Near its forward end, the deflector 81 extends upwardly toward the bottom wall 69 into relatively closely spaced relation thereto along a line 85 so that the height of the exit or discharge area or end 88 of the bottom wall conduit 77, adjacent the line 85, is small, whereby, in part, to compensate for the relatively long lateral length of the exit area 88, and thereby serving to keep the bottom wall conduit 77 full of coolant and thereby increasing the area through which heat Is removed from the oil in the sump 13 so as to provide more efficient cooling. In the area between the port 75 and the discharge area 88 of the bottom wall conduit 77, the dished portion 83 has a depth greater than at the discharge or exit area 88.

If desired, the bottom surface of the bottom wall 69 can be recessed as shown at 91 in the area between the port 75 and the close approximation of the deflector 81 to the bottom wall 69 at 91.

Any suitable means can be employed to fixed the deflector 81 to the bottom wall 69 of the upper housing section or portion 51. In the disclosed construction, a plurality of bolts 95 are employed as shown in FIG. 2.

The disclosed construction thus provides an arrangement whereby coolant water is led through one of the sump side walls 61, 63, 65 and 67, and along the bottom wall 69 to effect cooling of the oil in the sump 13 before discharge of the coolant water into the body of water in which the outboard motor 11 is operating.

The outboard motor 11 also includes an idle exhaust gas relief system 101 arranged so that the forwardly directed discharge from the bottom wall cooling conduit 77 is opposite in direction from the idle exhaust gas flow and such that, as a consequence, the idle exhaust gas flow includes therein a minimum of moisture.

Figure 7:
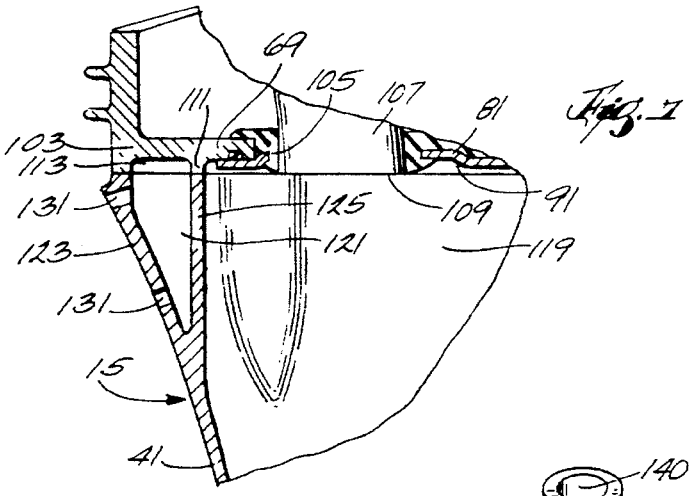
FIG. 7 is a fragmentary view, in section, of a portion of the outboard motor shown in FIG. 1.

More particularly, as shown in FIG. 7, the bottom or transverse wall 69 of the upper drive shaft housing portion includes a rearward portion 103 which extends rearwardly from the port 75 and which includes an opening 105 adapted to receive therein an exhaust pipe 107 which is independent of the upper drive shaft housing portion 51, which extends vertically in rearwardly spaced relation to the rearward wall 67, which extends downwardly beyond the deflector plate 81 and is adapted, at its upper end, to be connected to the power head 17, and which, at its lower end, extends downwardly beyond the deflector plate 81 and includes a discharge port 109 affording delivery of gases into the interior space of the intermediate drive shaft housing 41 in the area below the bottom wall 69 and rearwardly of the coolant discharge from the bottom wall cooling conduit 77.

Figure 8:
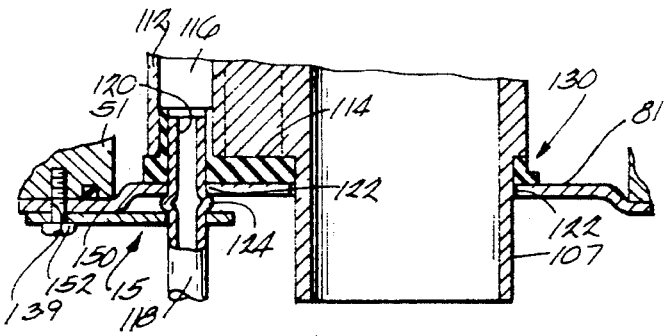
FIG. 8 is a fragmentary sectional view taken along line 8—8 of FIG. 2 and illustrating a modification.

In upwardly adjacent spaced relation from the lower end, the exhaust pipe 107 also includes (see FIG. 8) a coolant water inlet boss 112 having a lower horizontally extending surface 114 which includes a recess 116 communicating with an interior water passage (not shown), which water passage extends upwardly in the exhaust pipe 107 and communicates, at its upper end, with an engine water jacket (not shown).

Means are provided for supplying coolant water to the coolant water inlet recess 116. While other constructions can be employed, in the disclosed construction, such means comprises (see FIGS. 1 and 8) a coolant water supply pipe 118 which includes an upper end portion 120 extending upwardly through an opening 122 in the deflector plate 81 and into the recess 116, which extends downwardly from the recess 116 into the lower unit 15, and which includes adjacent, to the upper end thereof, an annular enlargement or boss 124.

Means are provided for sealing the connection between the coolant water supply pipe 118 and the coolant water recess 116 to prevent loss of coolant water therebetween, for sealing the lower end of the exhaust pipe 107 to the deflector plate 75 to prevent escape of exhaust gas therebetween, and for sealing the coolant water supply pipe 118 to the deflector plate 81 to prevent escape of exhaust gas through the opening 122 in the deflector plate 81 and between the deflector plate 81 and the coolant water supply pipe 118.

Figure 9:
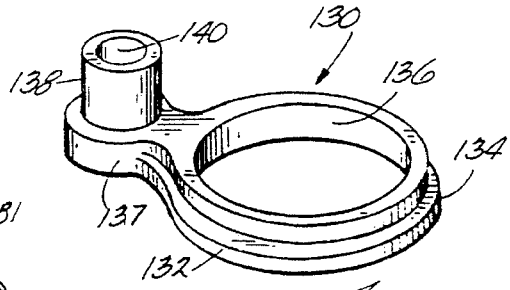
FIG. 9 is a perspective view of the grommet particularly shown in FIG. 8.

While other constructions can be employed, in the disclosed construction, such sealing means comprises (see FIG. 9) a unitary or one piece grommet 130 fabricated of resilient vibration absorbing material, such as rubber or rubber like material. The grommet 130 includes a generally planar portion 132 including a relatively thin annular subportion 134 defining an aperture 136 through which the lower end portion of the exhaust pipe 107 extends in sealing engagement therewith, and a flange subportion 136, together with an upwardly extending cylindrical portion 138 extending from the flange portion 136 and having an outer surface in sealing engagement with the inner surface of the coolant water inlet recess 116. The cylindrical portion 138 of the grommet 130 also includes a central bore or opening 140 which also extends through the flange subportion 136 and which sealingly engages the outer surface of the end portion 120 of the coolant water supply pipe 118 to prevent loss of coolant water from between the supply pipe 118 and the coolant water recess 116. The flange subportion 136 extends between the horizontally extending surface 114 of the water inlet boss 112 and the deflector plate 81 to prevent escape of exhaust gas therebetween.

The upper end of the water supply pipe 118 is retained in the coolant water inlet recess 116 by a strap 150 which is apertured to receive the water supply pipe 118 and which engages the underside of the enlargement 124 to hold the water supply pipe 118 in the coolant water inlet recess 116. In turn, the strap 150 is fixed to the upper housing portion 51 by suitable means including a bolt 152 which extends through the strap 150 and through an aperture 136 in the deflector plate 75, and which is threaded into the upper housing portion 51. In addition, the previously mentioned recess 91 in the bottom wall 69 extends into the bottom wall rearward portion 103 and, together with a transversely extending wall 111, defines an upper idle exhaust gas pocket or chamber 113 which communicates through port means in the form of a port 115 in the wall 111 with an area 117 of the recess 91 forwardly of the wall 111 but rearwardly of the exhaust pipe 107 and substantially rearwardly of the discharge area 88 of the bottom wall cooling conduit 77.

Further in addition, the upper end of the intermediate drive shaft housing portion 41 defines an interior space or cavity 119 which receives the forwardly directed discharge of coolant from the bottom wall conduit 77, and which receives exhaust gas from the discharge end or port 109 of the exhaust pipe 107. In connection with idle exhaust gas relief, the upper end of the intermediate drive shaft housing 41 includes, in a corner thereof, a lower idle exhaust gas pocket or chamber 121 which is defined by a rearward wall 123 and by a transverse wall 125 extending at its opposite ends from the rearward wall 123, and which is located directly below and cooperates with the idle exhaust gas pocket 113 in the recess 91 of the bottom wall 69 of the upper drive shaft housing portion 51 to define an exhaust gas idle relief expansion chamber.

Extending through the rearward wall 123, in vertically spaced relation, is port means in the form of two small openings or holes 131 which communicate between the lower pocket or chamber 121 and the atmosphere and which permit delivery of idle exhaust gas from the idle relief expansion chamber to the atmosphere at a level above the normal water level at idle.

It is particularly noted that the disclosed arrangement affords idle exhaust relief in a manner minimizing the amount of moisture in the idle exhaust gas discharge.

Various of the features of the invention are set forth in the following claims.

I claim:

1. A drive shaft housing including outer side walls extending in spaced relation to each other, a forwardly located wall extending between said outer side walls, a rearwardly located wall spaced rearwardly from said forwardly located wall and extending between said outer side walls, a bottom wall extending between said outer side walls and between said forwardly and rearwardly located walls, and having a bottom surface, said outer side walls, said forwardly and rearwardly located walls, and said bottom wall defining an oil sump, a coolant passage extending vertically in one of said outer side walls, said forwardly located wall, and said rearwardly located wall, being adapted, adjacent the upper end thereof, for connection to a source of coolant, and terminating, at the lower end thereof, in a discharge port located in said bottom wall, and a deflector fixed to said bottom wall and defining with said bottom surface of said bottom wall a conduit extending along said bottom wall and having a first end communicating with said discharge port in said bottom wall, and a discharge end terminating in an elongated discharge area defined between said bottom surface and a free edge of said deflector plate, whereby to provide coolant flow along a substantial portion of the bottom surface of said bottom wall.

2. A drive shaft housing in accordance with claim 1 wherein said conduit has a substantial lateral extent.

3. A drive shaft housing in accordance with claim 2 wherein said coolant passage has, adjacent said first end, a lateral extent approximating the lateral extent of said conduit, and wherein said discharge area has a lateral extent greater than the lateral extent of said conduit adjacent said first end.

4. A drive shaft housing in accordance with claim 1 wherein said deflector includes a dished portion which, at least in part, defines said conduit and which extends in spaced relation to said bottom wall.

5. A drive shaft housing in accordance with claim 4 wherein said dished portion is spaced from said bottom wall by a relatively small amount at said discharge end of said conduit and is spaced from said bottom wall at a greater amount in the area between said first end and said discharge end.

6. A drive shaft housing in accordance with claim 5 wherein said dished portion has outer sides which diverge from said first end toward said discharge end and which define therebetween said discharge area.

7. A drive shaft housing in accordance with claim 1 wherein said bottom wall includes a recessed portion in facing relation to said deflector.

8. A drive shaft housing including outer side walls extending in spaced relation to each other, a forwardly located wall extending between said outer side walls, a rearwardly located wall spaced rearwardly from said forwardly located wall and extending between said outer side walls, a bottom wall extending between said outer side walls and between said forwardly and rearwardly located walls, said outer side walls, said forwardly and rearwardly located walls, and said bottom wall defining an oil sump, and a deflector fixed to said bottom wall and defining with said bottom wall a conduit extending along said bottom wall and having a first end adapted to communicate with a source of coolant, a second end having an elongated discharge area, and side and rear peripheries, and said deflector also including a marginal portion extending along said side and rear peripheries of said conduit and in tight engagement with said bottom wall to define said conduit and to substantially prevent escape of coolant along said side and rear peripheries.

9. An oil sump including outer side walls extending in spaced relation to each other, a forwardly located wall extending between said outer side walls, a rearwardly located wall spaced rearwardly from said forwardly located wall and extending between said outer side walls, a bottom wall extending between said outer side walls and between said forwardly and rearwardly located walls, and having a bottom surface, and a deflector fixed to said bottom wall and defining with said bottom surface of said bottom wall a conduit extending along said bottom wall and having a first end adapted to communicate with a source of coolant, and a discharge end terminating in an elongated discharge area defined between said bottom surface of said bottom wall and a free edge of said deflector.

10. An oil sump in accordance with claim 9 and further including a coolant passage extending vertically in one of said outer side walls, said forwardly located wall, and said rearwardly located wall, being adapted, adjacent the upper end thereof, for connection to a source of coolant, and terminating, at the lower end thereof, in a port located in said bottom wall, and communicating with said first end of said conduit extending along said bottom wall.

11. An oil sump in accordance with claim 10 wherein said coolant passage has, adjacent said discharge end, a substantial lateral extent.

12. An oil sump in accordance with claim 9 wherein said bottom wall conduit has, adjacent said first a end, a lateral extent, and wherein said discharge area has a lateral extent greater than said first lateral extent.

13. An oil sump in accordance with claim 9 wherein said deflector includes a dished portion which, at least in part, defines said bottom wall conduit and which extends in spaced relation to said bottom wall.

14. An oil sump in accordance with claim 13 wherein said dished portion is spaced from said bottom wall by a relatively small amount at said discharge end of said conduit and is spaced from said bottom wall at a greater distance in the area between said first end and said discharge end.

15. An oil sump in accordance with claim 14 wherein said dished portion has outer sides which diverge from said first end toward said discharge end and which define therebetween said discharge area.

16. An oil sump in accordance with claim 9 wherein said bottom wall includes a recessed portion in facing relation to said deflector.

17. An oil sump including outer side walls extending in spaced relation to each other, a forwardly located wall extending between said outer side walls, a rearwardly located wall spaced rearwardly from said forwardly located wall and extending between said outer side walls, a bottom wall extending between said outer side walls and between said forwardly and rearwardly located walls, wall portions defining a space located adjacent one of said forwardly and rearwardly located walls and being adapted for passage therethrough of a drive shaft, and a deflector fixed to said bottom wall and defining with said bottom wall a conduit extending along said bottom wall and having a first end adapted to communicate with a source of coolant, a second end having an elongated discharge area, and side and rear peripheries, and said deflector also including a marginal portion extending along said side and rear peripheries of said conduit and in tight engagement with said bottom wall to define said conduit and to substantially prevent escape of coolant along said side and rear peripheries.

18. An outboard motor comprising a power head including a cooling jacket, a lower unit including a gear case, an intermediate drive shaft housing portion having a lower end fixed to said gear case and having an upper end, and an upper drive shaft housing portion including a lower end fixed to said upper end of said intermediate drive shaft housing portion, an upper end fixed to said power head, outer side walls extending in laterally spaced relation to each other between said upper and lower ends of said upper housing portion, a forwardly located wall extending between said outer side walls, a rearwardly located wall spaced rearwardly from said forwardly located wall and extending between said outer side walls, a bottom wall extending between said outer side walls and between said forwardly and rearwardly located walls, said outer side walls, said forwardly and rearwardly located walls, and said bottom wall defining an oil sump, a coolant passage extending vertically in said rearwardly located wall, being adapted, adjacent the upper end thereof, for connection to said power head coolant jacket for receipt therefrom of coolant discharged from said power head cooling jacket, and terminating, at the lower end thereof, in a port in said bottom wall, and a deflector fixed to said bottom wall and defining with said bottom wall a forwardly extending fan shaped conduit communicating with, and extending forwardly from, said port to a discharge area so as to enable coolant flow from said coolant passage conduit and along a substantial portion of the bottom surface of said bottom wall.

19. An outboard motor in accordance with claim 18 wherein said bottom wall includes a recessed portion in facing relation to said deflector, wherein said coolant passage has a substantial lateral extent, wherein said bottom wall conduit includes sides and rear peripheries, adjacent said port, a lateral extent approximating the lateral extent of said coolant passage, wherein said discharge area has a lateral extent greater than the lateral extent of said bottom wall conduit adjacent said port, and wherein said deflector includes a dished portion which is spaced from said bottom wall by a relatively small amount at said discharge area of said bottom wall conduit and is spaced from said bottom wall at a greater distance in the area between said discharge area and said port, which has outer sides diverging from said port toward said discharge area, and a marginal portion extending along said side and rear peripheries and engaging said bottom wall.

20. An outboard motor comprising a power head including a cooling jacket, and a lower unit including a gear case rotatably supporting a propeller, an intermediate drive shaft housing portion having a lower end connected to said gear case, and an upper end, an upper drive shaft housing portion including an upper end fixed to said power head, a lower end fixed to said upper end of said intermediate drive shaft housing portion, a transverse wall located adjacent said lower end of said upper drive shaft housing portion, defining, in part, an oil sump, and including therein an opening located rearwardly of said oil sump and adapted to receive an exhaust gas pipe having, at the lower end thereof, a discharge opening delivering exhaust gas into the interior space in said lower unit below said transverse wall, and a coolant discharge passage adapted, adjacent the upper end thereof, for connection to said power head coolant jacket for receipt therefrom of coolant discharge, and including, at the lower end thereof, a forwardly directed coolant discharge area located below said transverse wall, forwardly of said exhaust pipe, and adapted to forwardly discharge coolant into the interior space in said lower unit below said transverse wall, an idle exhaust gas relief chamber formed in said lower unit below said transverse wall, first port means communicating between said idle exhaust gas relief chamber and the atmosphere, and second port means communicating between said idle exhaust gas relief chaffer and said interior space in said lower unit below said transverse wall and at a location rearwardly of said forwardly directed coolant discharge area.

21. An outboard motor in accordance with claim 20 wherein said idle exhaust gas relief chamber includes an upper portion in said upper drive shaft housing portion formed, in part, by said transverse wall, and a lower portion formed in said intermediate drive shaft housing portion, wherein said first port means is located in said intermediate drive shaft housing portion, and wherein said second port means is located in said upper drive shaft housing portion.

22. An outboard motor in accordance with claim 21 wherein said second .port means is located rearwardly of said exhaust pipe discharge opening.

23. An outboard motor comprising a power head including a cooling jacket, and a lower unit including a gear case rotatably supporting a propeller, an intermediate drive shaft housing portion having an upper end defining an interior space, and a lower end connected to said gear case, an upper drive shaft housing portion including an upper end fixed to said power head, a lower end fixed to said upper end of said intermediate drive shaft housing portion, outer side walls extending in laterally spaced relation to each other between said upper and lower ends of said upper drive shaft housing portion, a forwardly located wall extending between said outer side walls, a rearwardly located wall spaced rearwardly from said forwardly located wall and extending between said outer walls, a bottom wall located at said lower end of said upper drive shaft housing portion and extending between said outer side walls and between said forwardly and rearwardly located walls, defining, with said outer side walls and said forwardly and rearwardly located walls, an oil sump, and including therein an opening located rearwardly of said rearward wall and adapted to receive an exhaust gas pipe having, at the lower end thereof, a discharge opening delivering exhaust gas into said interior space at said upper end of said intermediate drive shaft housing portion, and a coolant passage extending vertically in said rearwardly located wall and being adapted, adjacent the upper end thereof, for connection to said power head coolant jacket for receipt therefrom of coolant discharge, and terminating, at the lower end thereof in a forwardly open coolant discharge area located below said bottom wall and forwardly of said exhaust pipe, an idle exhaust gas relief chamber formed in said lower unit below said bottom wall, first port means communicating between said idle exhaust gas relief chamber and the atmosphere, and second port means communicating between said idle exhaust gas relief chamber and said interior space below said bottom wall and at a location rearwardly of said forwardly open coolant discharge area.

* * * * *